US008376783B2

(12) United States Patent
Kondo et al.

(10) Patent No.: US 8,376,783 B2
(45) Date of Patent: Feb. 19, 2013

(54) MULTIPOLAR CONNECTOR

(75) Inventors: Hayato Kondo, Yao (JP); Daisuke Sasaki, Isesaki (JP)

(73) Assignee: Hosiden Corporation, Yao-Shi, Osaka (JP)

( * ) Notice: Subject to any disclaimer, the term of this patent is extended or adjusted under 35 U.S.C. 154(b) by 178 days.

(21) Appl. No.: 12/824,691

(22) Filed: Jun. 28, 2010

(65) Prior Publication Data

US 2010/0330848 A1 Dec. 30, 2010

(30) Foreign Application Priority Data

Jun. 29, 2009 (JP) ..... 2009-153708

(51) Int. Cl.
*H01R 24/00* (2011.01)

(52) U.S. Cl. ..... 439/660; 439/79

(58) Field of Classification Search ..... 439/79, 439/108, 607.1, 607.5, 660, 941
See application file for complete search history.

(56) References Cited

U.S. PATENT DOCUMENTS

| | | | | |
|---|---|---|---|---|
| 6,210,218 | B1 * | 4/2001 | Chang | 439/567 |
| 6,464,541 | B1 * | 10/2002 | Hashim et al. | 439/676 |
| 6,916,209 | B1 * | 7/2005 | Casher et al. | 439/676 |
| 6,932,655 | B2 * | 8/2005 | Hatterscheid et al. | 439/676 |
| 7,166,000 | B2 * | 1/2007 | Pharney | 439/676 |
| 7,303,410 | B2 * | 12/2007 | Saito | 439/108 |
| 7,611,362 | B2 * | 11/2009 | Lin | 439/79 |
| 7,708,601 | B2 * | 5/2010 | Tanaka | 439/660 |
| 7,727,028 | B1 * | 6/2010 | Zhang et al. | 439/660 |
| 8,046,862 | B2 | 11/2011 | Eisermann et al. | |
| 8,060,968 | B2 | 11/2011 | Babb et al. | |
| 2007/0066115 | A1 | 3/2007 | Saito et al. | |
| 2007/0099512 | A1 | 5/2007 | Sato | |

FOREIGN PATENT DOCUMENTS

| | | | |
|---|---|---|---|
| EP | 1531527 | A2 | 5/2005 |
| EP | 2015402 | A2 | 1/2009 |
| JP | 2007-214139 | | 8/2007 |

* cited by examiner

*Primary Examiner* — Thanh Tam Le
(74) *Attorney, Agent, or Firm* — Rankin, Hill & Clark LLP

(57) ABSTRACT

The invention provides a multipolar connector wherein one terminal row can be divided into a plurality of rows (row conversion) while reducing an impedance mismatch. A multipolar connector (1) includes a terminal group (40) in which a plurality of terminals (4) are arranged in one row in contact portions (4*a*) with respect to terminals of a counter connector, and, while being then passed through a row converting portion (45), one terminal row (41) is divided into a plural-row portion (44) consisting of two rows (42, 43) and functioning as a connecting portion that is opposite to the counter connector, and row-converted to a substantially zigzag arrangement. The terminal group includes two specific terminals (46, 47) in which, in the plural-row portion (44), the terminal width (L1) is wider than the terminal width (L2) of the contact portions (4*a*). The two specific terminals constitute a terminal pair for transmitting differential signals.

3 Claims, 13 Drawing Sheets

MULTIPOLAR CONNECTOR

TECHNICAL FIELD

The present invention relates to a multipolar connector, and more particularly to a multipolar connector which is to be mounted on a printed circuit board, and which includes a plurality of terminals for insertion mounting.

BACKGROUND ART

In the case where, in a multipolar connector, a plurality of terminals for insertion mounting are arranged in one row in contact portions with respect to terminals of a counter connector, also board mounting portions of the terminals are drawn out to the outside, and inserted into and soldered to through holes which are disposed in one row on a printed circuit board (for example, see Patent Literature 1).

A multipolar connector is strongly requested to be miniaturized and have a larger number of terminals. In a conventional multipolar connector, even when the size is to be further reduced and the terminal number is to be further increased, however, reduction of the terminal pitch is limited by the pitch of through holes. Therefore, there is a problem in that, in a multipolar connector, also miniaturization and increase of terminals are restricted.

PRIOR ART LITERATURE

Patent Literature

[Patent Literature 1] Japanese Patent Application Laying-Open No. 2007-214139

DISCLOSURE OF THE INVENTION

Problems to be Solved by the Invention

In a multipolar connector, even in the case where a plurality of terminals are arranged in one row in contact portions with respect to terminals of a counter connector, the one terminal row may be divided into two rows in front of board mounting portions to row-convert the arrangement to a zigzag arrangement, and the limitation due to the pitch of through holes is mitigated, so that the pitch of the terminals can be further reduced. In such a multipolar connector, therefore, miniaturization and increase of terminals can be realized. Recently, many of terminal groups include terminal pairs or the like in which two adjacent terminals are paired to transmit high-speed differential signals. When one terminal row is divided into two rows, the gap in a terminal pair is increased in the divided portion, and the electrical coupling state is impaired, thereby causing a problem in that an impedance mismatch is produced and high-speed differential signals cannot be efficiently transmitted.

It is an object of the invention to provide a multipolar connector in which one terminal row can be divided into a plurality of rows (row conversion) while reducing an impedance mismatch.

Means for Solving the Problems

In order to achieve the object, the multipolar connector of the invention includes a terminal group in which a plurality of terminals are arranged in one row in contact portions with respect to terminals of a counter connector, and, while being then passed through a row converting portion, one terminal row is divided into a plural-row portion consisting of two or more rows and functioning as a connecting portion that is opposite to the counter connector, and the terminal group includes a plurality of specific terminals in which, in the plural-row portion, a terminal width is wider than the contact portions. The impedances are previously matched to each other between the contact portions of the specific terminals, the capacitance is increased by increasing the terminal widths of the specific terminals in the plural-row portion, and the increase of the impedance between the specific terminals is suppressed. Namely, an impedance mismatch is reduced.

According to the invention, in the specific terminals, preferably, the terminal width is widened starting from the row converting portion. In the row converting portion, the terminals are bent, and the one terminal row is divided into the plural-row portion consisting of two or more rows, and therefore a resistance for a high frequency is easily produced, so that the impedance is caused to be increased in a similar manner as the plural-row portion. When the terminal width is increased starting from the row-converting portion, however, the impedance matching can be more easily attained.

Effects of the Invention

According to the invention, it is possible to provide a multipolar connector in which one terminal row can be divided into a plurality of rows (row conversion) while reducing an impedance mismatch.

MODE FOR CARRYING OUT THE INVENTION

Figure 1:
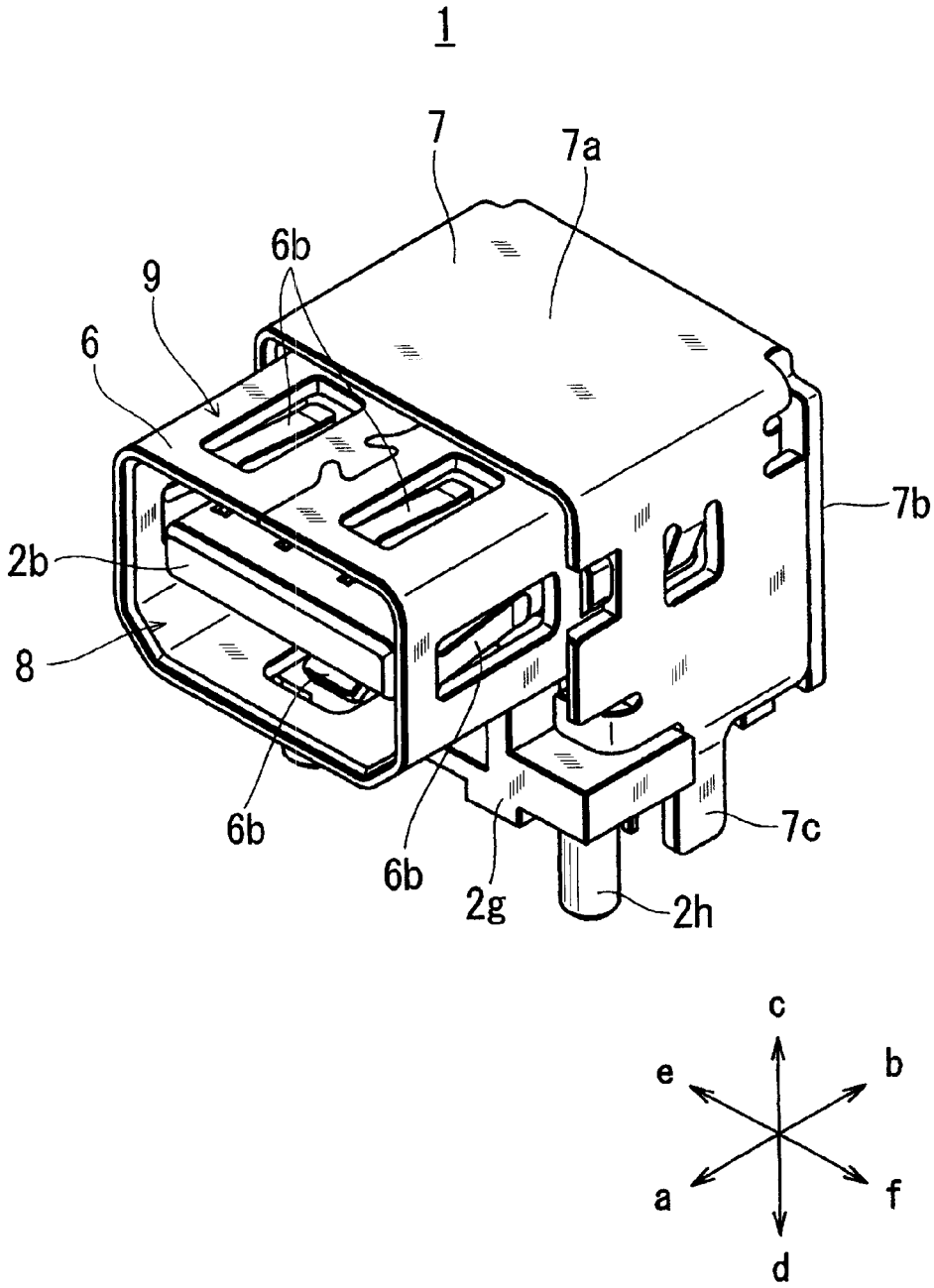
FIG. 1 is a front perspective view of a multipolar connector which is an embodiment of the invention.
Figure 2:
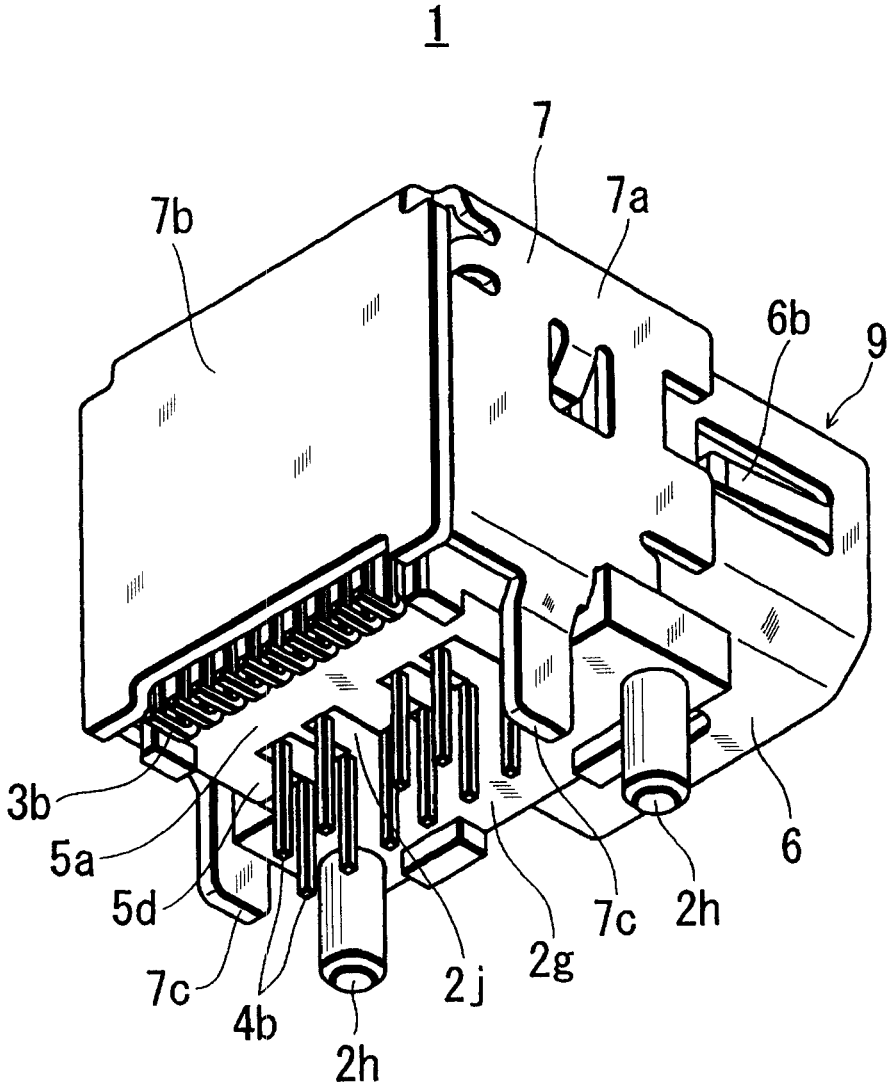
FIG. 2 is a rear perspective view of the multipolar connector.
Figure 3:
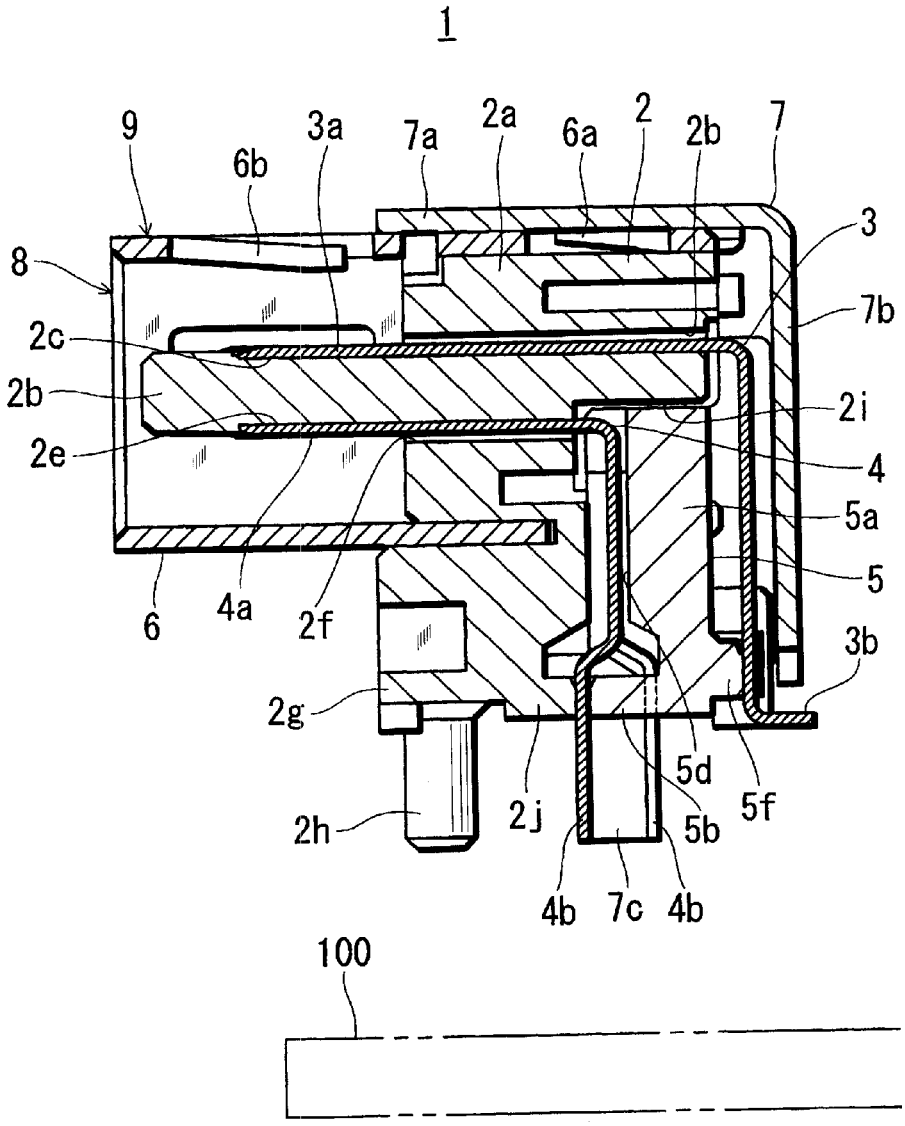
FIG. 3 is a sectional view of the multipolar connector.
Figure 4:
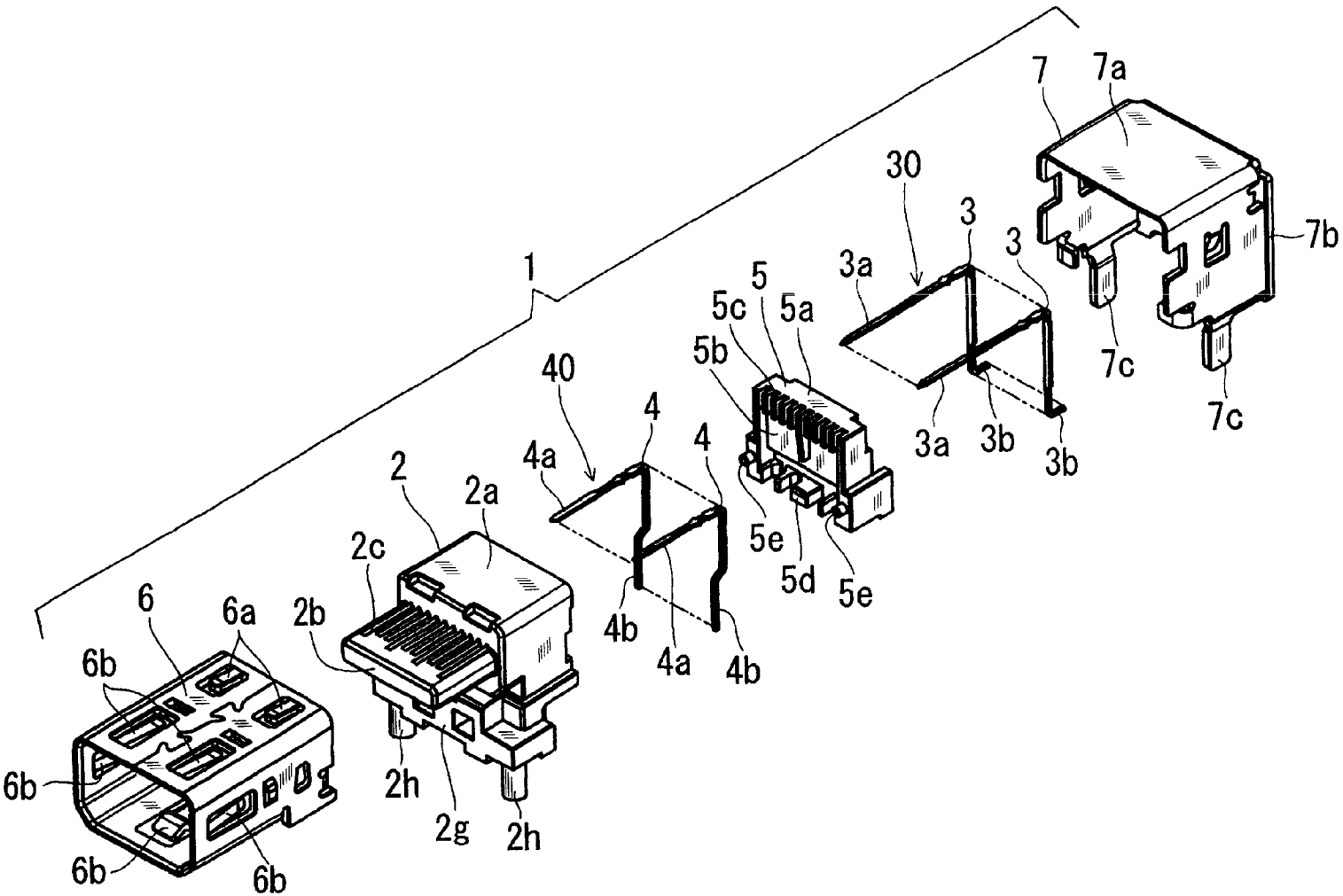
FIG. 4 is a front perspective view of the multipolar connector in a disassembled state.

Hereinafter, an embodiment of the invention will be described with reference to the drawings. FIG. 1 is a front perspective view of a multipolar connector which is an embodiment of the invention, FIG. 2 is a rear perspective view of the multipolar connector, FIG. 3 is a sectional view of the multipolar connector, and FIG. 4 is a front perspective view of the multipolar connector in a disassembled state. The multipolar connector 1 shown in FIGS. 1 to 4 is a lateral type mini display port connector (socket) which is to be mounted on a printed circuit board 100 (see FIG. 3) on the side of an apparatus, and into which a counter connector (not shown) (a plug which is attached to an end of a connection cable between apparatuses) is inserted and fitted parallel to the printed circuit board 100 (a vertical type connector is inserted and fitted vertical to the printed circuit board 100). In the following description, it is assumed that, in FIG. 1, the direction of the arrow a-b coincides with the longitudinal direction of the multipolar connector, that of the arrow c-d coincides with the vertical direction of the multipolar connector, and that of the arrow e-f coincides with the lateral direction of the multipolar connector 1.

As shown in FIG. 4, the multipolar connector 1 is configured by: the body 2; an upper terminal group 30 consisting of a set of ten terminals for surface mounting, and a lower terminal group 40 consisting of a set of ten terminals for insertion mounting (a total of twenty terminals); a terminal spacer 5; a connector shell 6; and a shield cover 7.

Figure 5:
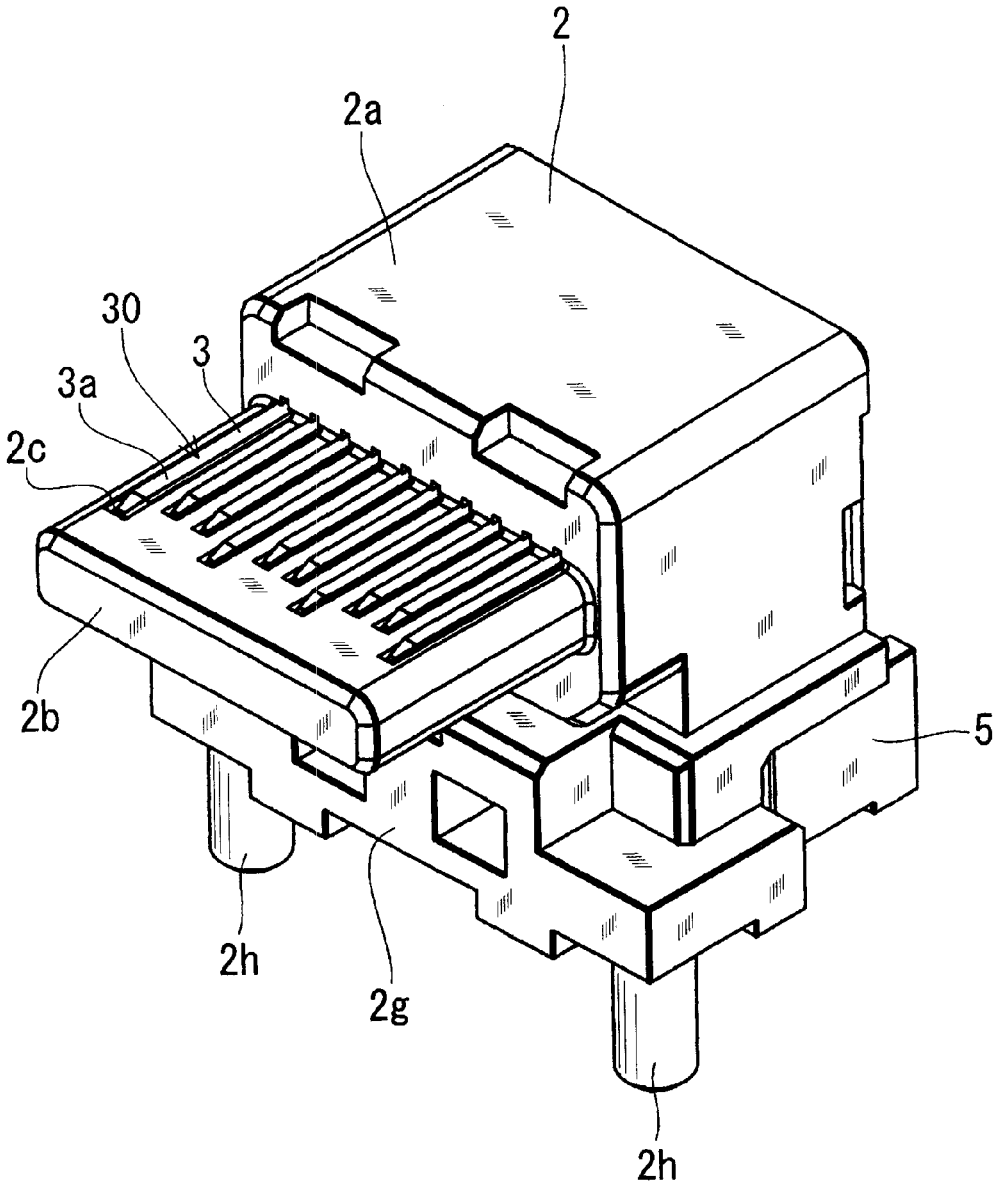
FIG. 5 is a front perspective view of the body of the multipolar connector in a state where an upper terminal group is attached to the body.
Figure 6:
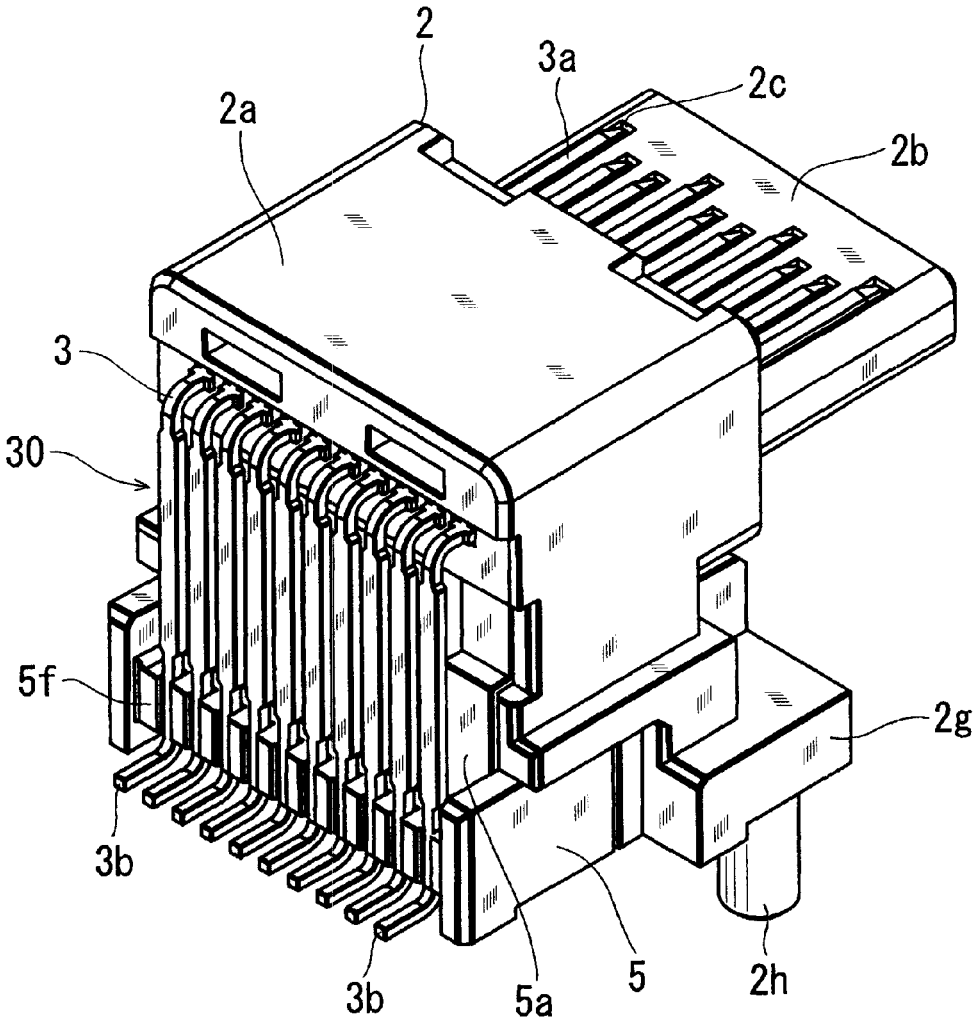
FIG. 6 is a rear perspective view of the body of the multipolar connector in a state where the upper terminal group is attached to the body.
Figure 7:
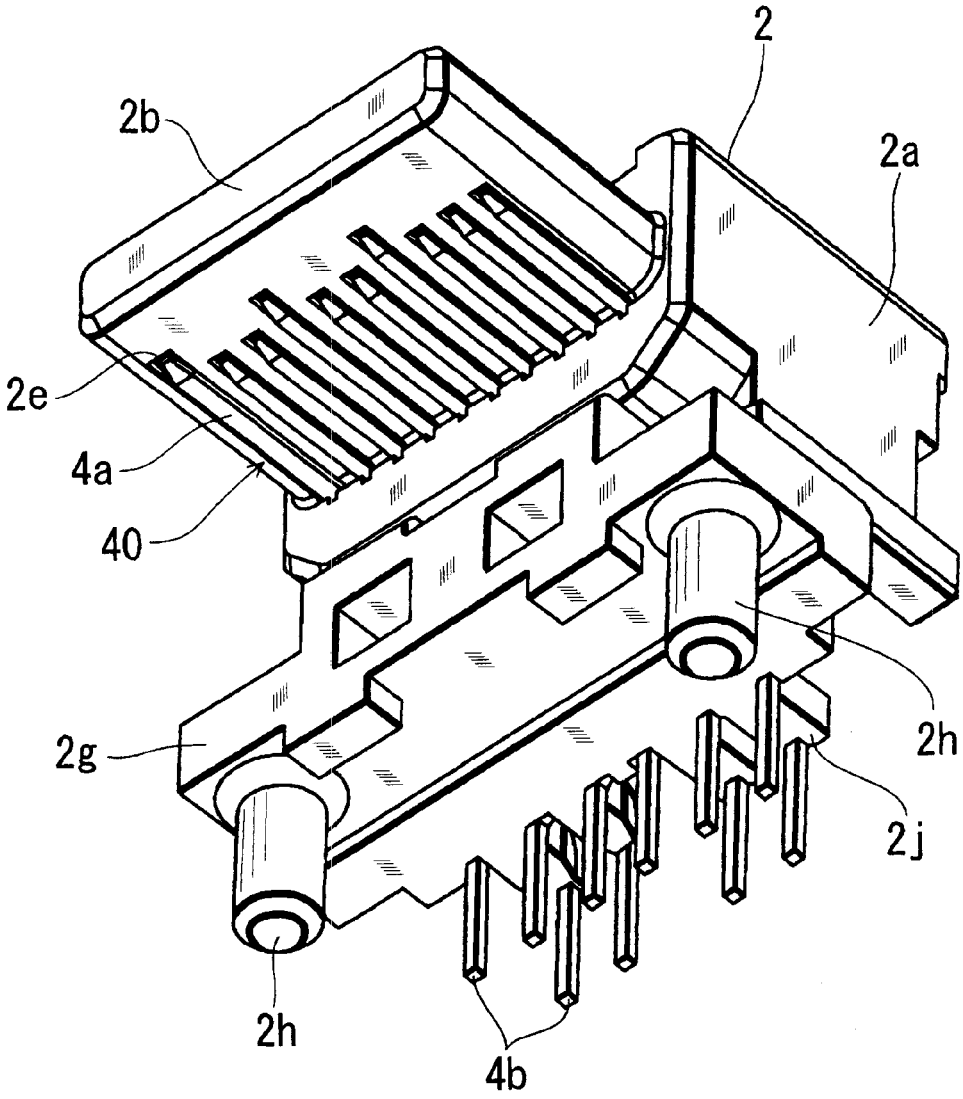
FIG. 7 is a front perspective view of the body of the multipolar connector in a state where a lower terminal group is attached to the body.
Figure 8:
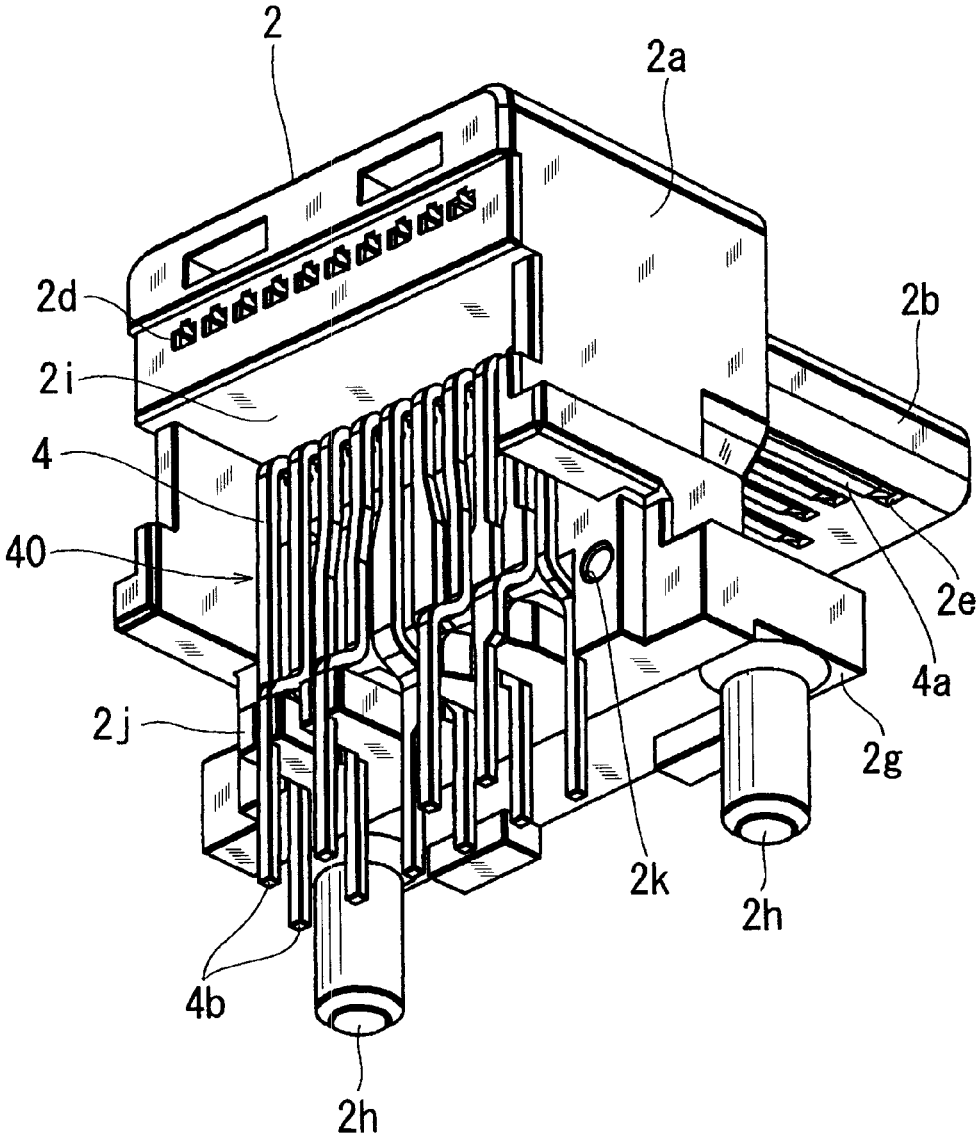
FIG. 8 is a rear perspective view of the body of the multipolar connector in a state where the lower terminal group is attached to the body.

FIG. 5 is a front perspective view of the body in a state where the upper terminal group is attached to the body, FIG. 6 is a rear perspective view of the body in a state where the upper terminal group is attached to the body, FIG. 7 is a front perspective view of the body in a state where the lower terminal group is attached to the body, and FIG. 8 is a rear perspective view of the body a state where the lower terminal group is attached to the body.

As shown in FIGS. 3 to 8, the body 2 is a molded product made of an insulative material such as a synthetic resin. In the body, the followings are integrally formed: a terminal support basal portion 2*a* having a substantially rectangular parallelepiped shape; a terminal supporting portion 2*b* which is forward horizontally protruded from a substantially middle part of the front face of the terminal support basal portion 2*a*, and which has a substantially rectangular plate like shape; ten upper-terminal press insertion grooves 2*c* which are juxtaposed in one lateral row in the upper surface of the terminal supporting portion 2*b* at substantially regular intervals so as to be parallel to one another in the longitudinal direction; upper-terminal insertion holes 2*d* which allow the upper-terminal press insertion grooves 2*c* to be linearly passed to the rear face of the terminal support basal portion 2*a*; ten lower-terminal press insertion grooves 2*e* which are juxtaposed in one lateral row in the lower surface of the terminal supporting portion 2*b* at substantially regular intervals so as to be parallel to one another in the longitudinal direction; lower-terminal insertion holes 2*f* which allow the lower-terminal press insertion grooves 2*e* to be linearly passed to the rear face of the terminal support basal portion 2*a*; a leg portion 2*g* which supports the terminal support basal portion 2*a* from the lower side; two right and left positioning pins 2*h* which are downward protruded from the lower face of the leg portion 2*g*; a lower-terminal housing recess 2*i* which is disposed on the rear face of the body 2 (the rear faces of the terminal support basal portion 2*a* and the leg portion 2*g*); a lower-terminal clamping convex and concave portion 2*j* which is disposed in a lower portion of the lower-terminal housing recess 2*i*; two right and left positioning holes 2*k* which are disposed on the laterally outer sides of the lower-terminal clamping convex and concave portion 2*j*; and engaging portions with respect to the connector shell 6 and the shield cover 7.

As shown in FIGS. 3 to 8, each of the ten upper terminals 3 (the upper terminal group 30) is configured by a thin electrode terminal which is bent into an L-like shape as a whole, and attached to the body 2 in a state where one part of the L-like shape is press-inserted into the corresponding upper-terminal press insertion groove 2*c* while being passed through the corresponding upper-terminal insertion hole 2*d* from the rear side of the body 2, and the L-shaped other part is attached to the body 2 while being downward drawn out in the rear side of the body 2. Tip end portions (front end portions) of the L-shaped one parts which are press-inserted into the upper-terminal press insertion grooves 2*c* form contact portions 3*a* with respect to ten upper terminals of the counter connector, and tip end portions (lower end portions) of the L-shaped other parts which are downward drawn out in the rear side of the body 2 form board mounting portions 3*b* with respect to the printed circuit board 100. Since the upper terminals 3 are used for surface mounting, the board mounting portions 3*b* are formed by perpendicularly bending the tip end portions of the L-shaped other parts which are downward drawn out in the rear side of the body 2, so as to be parallel to the printed circuit board 100. The contact portions 3*a* of the ten upper terminals 3 are arranged in one lateral row in the upper surface of the terminal supporting portion 2*b* at substantially regular intervals so as to be parallel to one another in the longitudinal direction, through the ten upper-terminal press insertion grooves 2*c*. The one terminal row extends to the board mounting portions 3*b* while being held as it is. Namely, the ten upper terminals 3 are arranged in one lateral row over their whole lengths.

The ten upper terminals 3 are collectively formed so as to respectively have a strip-like shape in which the tip end portions of the board mounting portions 3*b* are connected to one another by a carrier portion (not shown), and which are laterally arranged in one row, by applying a pressing process such as a punching process or a bending process on a metal thin plate (a hoop material) having a high electrical conductivity. The assembly in this state is attached to the body 2, and then separated from the carrier portion to be collectively attached as the ten individual upper terminals 3 to the body 2.

As shown in FIGS. 3 to 8, each of the ten lower terminals 4 (the lower terminal group 40) is configured by a thin electrode terminal which is bent into an L-like shape as a whole, and attached to the body 2 in a state where one part of the L-like shape is press-inserted into the corresponding lower-terminal press insertion groove 2*e* while being passed through the corresponding lower-terminal insertion hole 2*f* from the rear side of the body 2, and the L-shaped other part is attached to the body 2 while being downward drawn out in the lower-terminal housing recess 2*i* of the body 2. Tip end portions (front end portions) of the L-shaped one parts which are press-inserted into the lower-terminal press insertion grooves 2*e* form contact portions 4*a* with respect to ten lower terminals of the counter connector, and tip end portions (lower end portions) of the L-shaped other parts which are downward drawn out in the lower-terminal housing recess 2*i* of the body 2 form board mounting portions 4*b* with respect to the printed circuit board 100. Since the lower terminals 4 are used for insertion mounting, the board mounting portions 4*b* are formed there into a pin structure without bending the tip end portions of the L-shaped other parts which are downward drawn out in the rear side of the body 2, so as to be perpendicular to the printed circuit board 100. The contact portions 4*a* of the ten lower terminals 4 are arranged in one lateral row in the lower surface of the terminal supporting portion 2*b* at substantially regular intervals so as to be parallel to one another in the longitudinal direction, through the ten lower-terminal press insertion grooves 2*e*. The one terminal row is divided into two front and rear rows to be row-converted to a substantially zigzag arrangement, in middles (in front of the board mounting portions 4*b*) of the L-shaped other parts which are downward drawn out in the rear side of the body 2. Namely, in the contact portions 4*a*, the ten lower terminals 4 are arranged in one lateral row, but, in the board mounting portions 4*b*, divided into two front and rear rows to be arranged in a substantially zigzag manner. The row converting structure of the lower terminal group 40 will be described later.

In the ten lower terminals 4, the lower portions of the L-shaped other parts which are downward drawn out in the rear side of the body 2 (portions in immediately front of the board mounting portions 4*b* which are divided into two front and rear rows to be arranged in a substantially zigzag manner) are supported from the front side by the lower-terminal clamping convex and concave portion 2*j* of the body 2.

The ten lower terminals 4 are completed in the following manner. Similarly with the ten upper terminals 3, first, the tip end portions of the board mounting portions 4*b* are collectively formed so as to respectively have a strip-like shape in which the tip end portions are connected to one another by a carrier portion (not shown), and which are laterally arranged in one row in a range from the contact portions 4*a* to the board mounting portions 4*b*, by applying a pressing process such as a punching process or a bending process on a metal thin plate (a hoop material) having a high electrical conductivity. Thereafter, the carrier portion is cut off to form the ten individual lower terminals 4, and in this state a bending process is applied on middles of the L-shaped other parts, thereby performing the row conversion. Then, the ten individual lower terminals 4 are collectively attached to the body 2. In this way, the ten lower terminals 4 are collectively produced, so that the production cost can be suppressed to a low level as compared with the case where rows are respectively produced.

As shown in FIGS. 2 to 6, the terminal spacer 5 is a molded product made of an insulative material such as a synthetic resin. In the spacer, the followings are integrally formed: a terminal group spacer portion 5*a* which can be fitted to the lower-terminal housing recess 2*i* of the body 2, and which has a substantially rectangular parallelepiped shape; a lower-terminal housing recess 5*b* which is disposed on the front face of the terminal group spacer portion 5*a*; a lower-terminal spacer portion 5*c* which is disposed in an upper portion of the lower-terminal housing recess 5*b*; a lower-terminal clamping convex and concave portion 5*d* which is disposed in a lower portion of the lower-terminal housing recess 5*b*; two right and left positioning pins 5*e* which are forward protruded from the lateral outer sides of the lower-terminal clamping convex and concave portion 5*d*; convex and concave upper-terminal spacer portion 5*f* which is disposed in a lower portion of the rear face of the terminal group spacer portion 5*a*; and an engaging portion with respect to the connector shell 6.

After the ten lower terminals 4 are attached to the body 2, the terminal spacer 5 is attached to the body 2. When the terminal spacer 5 is to be attached to the body 2, the terminal group spacer portion 5*a* is fitted to the lower-terminal housing recess 2*i* of the body 2 while the two right and left positioning pins 5*e* are inserted into the two right and left positioning holes 2*k* from the rear side of the body 2. In the ten lower terminals 4, between the terminal support basal portion 2*a* (the body 2) and the terminal group spacer portion 5*a* (the terminal spacer 5), the L-shaped other parts (excluding the board mounting portions 4*b*) which are downward drawn out in the rear side of the body 2 are housed in a space which is formed by the lower-terminal housing recess 2*i* of the body 2 and the lower-terminal housing recess 5*b* of the terminal spacer 5 (excluding the board mounting portions 4*b*), and row-converted in the space. In the ten lower terminals 4, in the upper portion (in which the row conversion has not yet been performed), the L-shaped other parts which are downward drawn out in the rear side of the body 2 are fitted into recesses of the lower-terminal spacer portion 5*c* of the terminal spacer 5, and protrusions of the lower-terminal spacer portion 5*c* of the terminal spacer 5 are fitted between upper terminals of the L-shaped other parts, and, in the lower portion (which is in front of the board mounting portions 4*b*, and in which the row conversion has been performed), clamped between the lower-terminal clamping convex and concave portion 2*j* of the body 2 and the lower-terminal clamping convex and concave portion 5*d* of the terminal spacer 5 while being supported from the rear side by the lower-terminal clamping convex and concave portion 5*d* of the terminal spacer 5, whereby both the gaps between the terminals and those between the rows are adequately held. In other words, they are surely insulated from one another.

After the terminal spacer 5 are attached to the body 2, the ten upper terminals 3 are attached to the body 2. In the ten upper terminals 3, the L-shaped other parts are downward drawn out in the rear side of the terminal spacer 5, the terminal group spacer portion 5*a* of the terminal spacer 5 is sandwiched between the L-shaped other parts of the ten upper terminals 3 and those of the ten lower terminals 4, and the gaps between the L-shaped other parts of the ten upper terminals 3 and those of the ten lower terminals 4 are adequately held by the terminal group spacer portion 5*a* of the terminal spacer 5. In other words, they are surely insulated from one another. In the ten upper terminals 3, the lower portions (in front of the board mounting portions 3*b*) of the L-shaped other parts which are downward drawn out in the rear side of the terminal spacer 5 are fitted into recesses of the upper-terminal spacer portion 5*f* of the terminal spacer 5, and protrustions of the upper-terminal spacer portion 5*f* of the terminal spacer 5 are fitted between lower terminals of the L-shaped other parts, whereby the gaps between the terminals are adequately held. In other words, they are surely insulated from one another.

As shown in FIGS. 1 to 4, the connector shell 6 is formed into a substantially rectangular cylindrical shape by applying a pressing process such as a punching process or a bending process on one metal thin plate having an electrical conductivity. The connector shell is attached to the body 2 in a state where the rear portion of the substantially rectangular cylindrical shape is fitted onto the terminal support basal portion 2*a* from the front side of the body 2, and the terminal supporting portion 2*b* in which the contact portions 3*a* of the ten upper terminals 3 are arranged in one lateral row on the upper surface, and the contact portions 4*a* of the ten lower terminals 4 are arranged in one lateral row on the lower surface is surrounded by the substantially rectangular cylindrical shape. In the connector shell, an opening 8 is formed in the front end side to form a fitting portion 9 with respect to the counter connector. The counter connector can be inserted and fitted from the front side into the fitting portion. In the connector shell 6, a plurality of cantilevered spring contact pieces 6*a* which are always pressingly contacted with the shield cover 7 to always cause the connector shell 6 to be electrically connected with the shield cover 7, and a plurality of cantilevered spring contact pieces 6*b* which, when the counter connector is fitted, are pressingly contacted with an electrically conductive connector shell of the counter connector to cause the connector shells to be electrically connected with each other are disposed. The spring contact pieces 6*a*, 6*b* are formed by partially cutting and raising the connector shell 6. In the connector shell 6, furthermore, a body engaging portion which cooperates with a shell engaging portion of the body 2 to prevent separation (slipping off) from the body 2 from occurring, an engaging portion which cooperates with a connector shell engaging portion of the terminal spacer 5 to prevent the terminal spacer 5 from separating (slipping off) from the body 2, and an engaging portion with respect to the shield cover 7 are disposed.

As shown in FIGS. 1 to 4, the shield cover 7 is formed by applying a pressing process such as a punching process or a bending process on one metal thin plate having an electrical conductivity. In the shield cover, a cover portion 7*a* which covers the three upper, and right and left side faces of the terminal support basal portion 2*a* of the body 2, and a lid portion 7*b* configured by a top-plate elongation portion which is rearward elongated in a bendable manner from the rear edge of the top plate of the cover portion 7*a* are disposed. In the final stage of the step of assembling the multipolar connector 1, the shield cover 7 is attached to the body 2 by fitting the cover portion 7*a* in a state where the lid portion 7*b* is opened, onto the terminal support basal portion 2*a* from the rear side of the body 2. After the attachment, the opened lid portion 7*b* is closed to cover the three upper, and right and left side faces of the terminal support basal portion 2*a* from the upper side of the connector shell 6, and cover the rear face (the terminal support basal portion 2*a* and the rear face of the terminal spacer 5) of the body 2 from the upper side of the L-shaped other parts of the ten upper terminals 3 which are downward drawn out in the rear side of the body 2, so that the lid portion cooperates with the connector shell 6 to constitute a shield of the multipolar connector 1. In the shield cover 7, two right and left terminal portions 7*c* for insertion mounting which are downward protruded from both end portions of the cover portion 7*a*, respectively are disposed in order to electrically connect a shield of the counter connector with the printed circuit board 100 through the connector shell 6. Furthermore, the shield cover 7 cooperates with the shield cover engaging portions of the body 2 to dispose a body engaging portion for preventing separation from the body 2 from occurring, and an engaging portion with respect to the connector shell 6.

Figure 9:
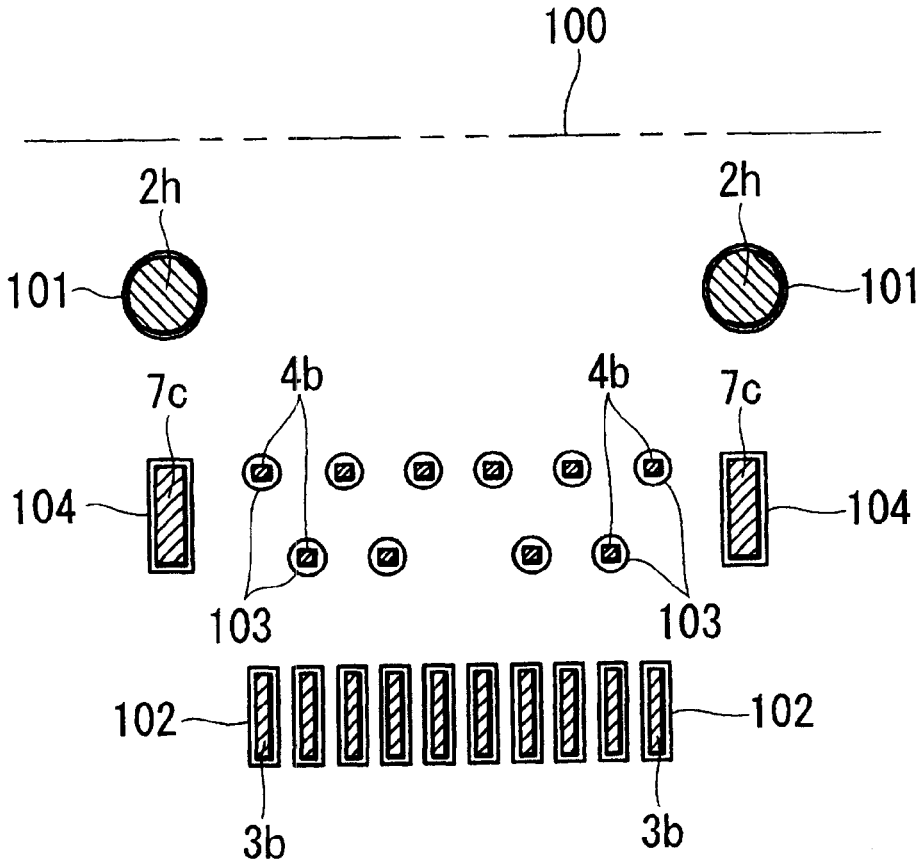
FIG. 9 is a layout diagram of lands and through holes of a printed circuit board on which the multipolar connector is to be mounted.

FIG. 9 is a layout diagram of lands and through holes of the printed circuit board.

In the printed circuit board 100, as shown in FIG. 9, disposed are: two positioning holes 101 which are placed correspondingly with the two right and left positioning pins 2*h* of the body 2; ten lands 102 for surface mounting which are arranged in one row correspondingly with the board mounting portions 3*b* of the ten upper terminals 3; ten through holes 103 which are arranged in two zigzag rows correspondingly with the board mounting portions 4*b* of the ten lower terminals 4; and two through holes 104 for grounding which are placed correspondingly with the two right and left terminal portions 7*c* of the shield cover 7. When the multipolar connector 1 is to be mounted on the printed circuit board 100, the multipolar connector 1 is placed on the surface of the printed circuit board 100 where the ten lands 102 are disposed, while the two right and left positioning pins 2*h* of the body 2 are inserted into the two positioning holes 101 of the printed circuit board 100, the board mounting portions 3*b* of the ten upper terminals 3 are overlapped on the ten lands 102 of the printed circuit board 100, the board mounting portions 4*b* of the ten lower terminals 4 are inserted into the ten through holes 103 of the printed circuit board 100, and the two right and left terminal portions 7*c* of the shield cover 7 are inserted into the two grounding through holes 104 of the printed circuit board 100. In this state, the board mounting portions 3*b* of the ten upper terminals 3 are reflow soldered to the ten lands 102 of the printed circuit board 100 to mechanically fix and electrically connect (surface mount) the ten upper terminals 3 to the printed circuit board 100. Thereafter, the printed circuit board 100 is turned over, and the board mounting portions 4*b* of the ten lower terminals 4 are flow soldered to the ten through holes 103 of the printed circuit board 100 to mechanically fix and electrically connect (insertion mount) the ten lower terminals 4 to the printed circuit board 100. The two right and left terminal portions 7*c* of the shield cover 7 are flow soldered to the two grounding through holes 104 of the printed circuit board 100 to mechanically fix and electrically connect (insertion mount) the shield cover 7 to the printed circuit board 100.

In the multipolar connector 1, when the counter connector is inserted and fitted from the front side into the fitting portion 9 through the opening 8, the contact portions 3*a* of the ten upper terminals 3 are contacted with the ten upper terminals of the counter connector, respectively to cause the ten upper terminals of the counter connector to electrically connect with the printed circuit board 100 through the ten upper terminals 3, respectively, the contact portions 4*a* of the ten lower terminals 4 are contacted with the ten lower terminals of the counter connector, respectively to cause the ten lower terminals of the counter connector to electrically connect with the printed circuit board 100 through the ten lower terminals 4, respectively, thereby enabling, for example, a video signal, an audio signal, a control signal, a clock signal, and the like to be transmitted, the shield cover 7 electrically connects (ground-connects) the shield of the counter connector with the printed circuit board 100 through the connector shell 6, so that the shielding function (electromagnetic interference countermeasure) is exerted.

Figure 10:
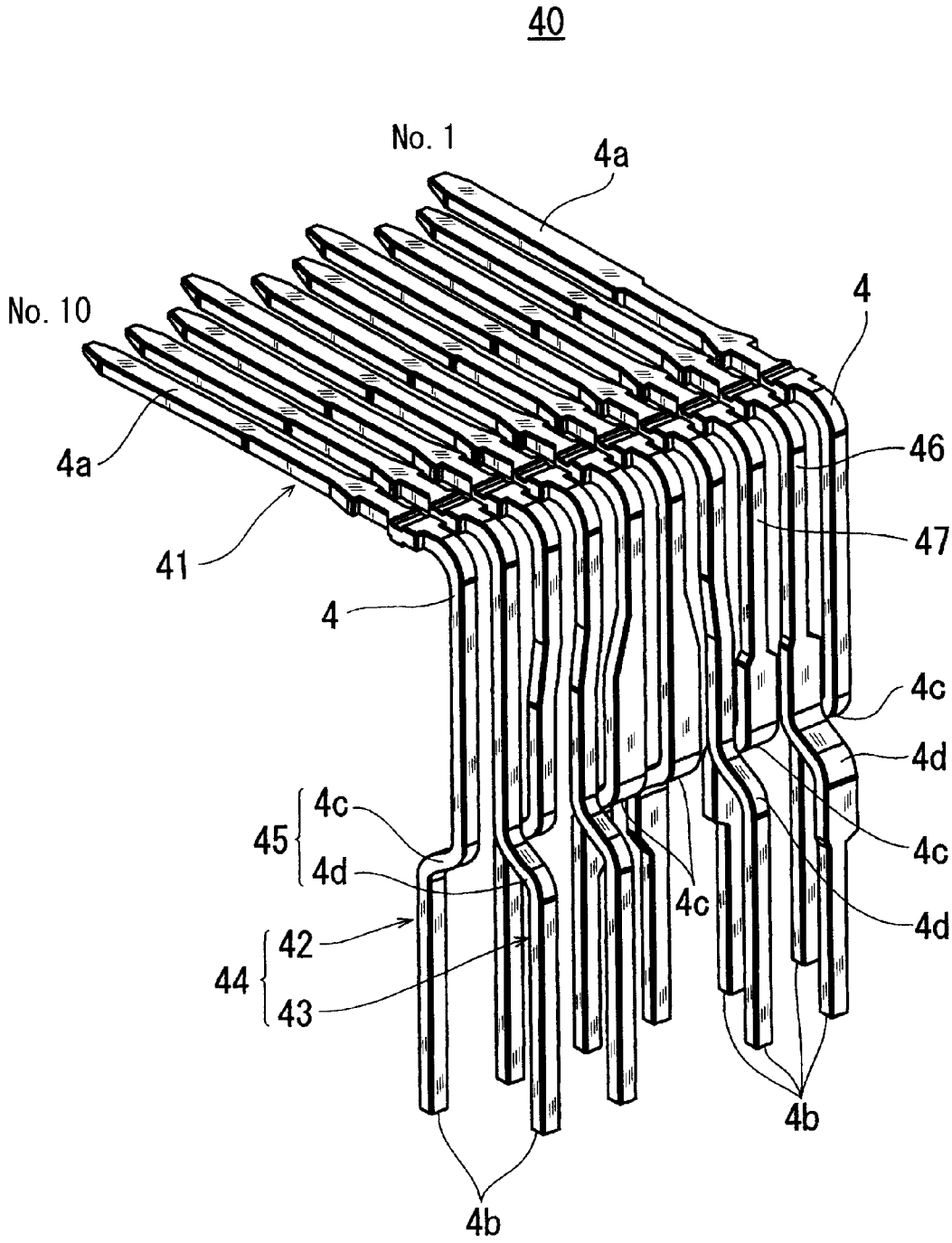
FIG. 10 is a rear perspective view of the lower terminal group of the multipolar connector.

Next, the row converting structure of the lower terminal group 40 will be described with reference to FIGS. 10 to 13. FIG. 10 is a rear perspective view of the lower terminal group, FIG. 11 is a bottom view of the lower terminal group, FIG. 12 is a rear view of the lower terminal group, and FIG. 13 is a side view of the lower terminal group.

As described above, the ten lower terminals 4 constituting the lower terminal group 40 are bent into an L-like shape as a whole, the L-shaped one parts which form the contact portions 4*a* with respect to the ten lower terminals of the counter connector are press-inserted into the lower-terminal press insertion grooves 2*e* from the rear side of the body 2 through the lower-terminal insertion holes 2*f* to be arranged in one lateral row at substantially regular intervals so as to be parallel to one another in the longitudinal direction (the insertion and extraction direction of the counter connector). By contrast, the L-shaped other parts which form the connecting portion opposite to the counter connector, i.e., that with respect to the printed circuit board 100 are downward drawn out in the rear side of the body 2, and the tip end portions (lower end portions) of the L-shaped other parts form the board mounting portions 4*b* with respect to the printed circuit board 100. If the L-shaped other parts are arranged in one lateral row in a similar manner as the L-shaped one parts, also the board mounting portions 4*b*, and the through holes 103 of the printed circuit board 100 into which the portions are to be inserted are naturally arranged in one lateral row. Therefore, reduction of the pitch of the lower terminals 4 is limited by the pitch of the through holes 103 of the printed circuit board 100, and therefore there is a problem in that also miniaturization and increase of terminals of the multipolar connector 1 are restricted. In order to solve the problem, a row converting portion 45 which, in front of the board mounting portions 4*b*, divides one terminal row 41 into a plural-row portion 44 consisting of two front and rear rows 42, 43, and which row-converts the terminal row to a substantially zigzag arrangement is disposed in middles of the L-shaped other parts.

Figure 11:
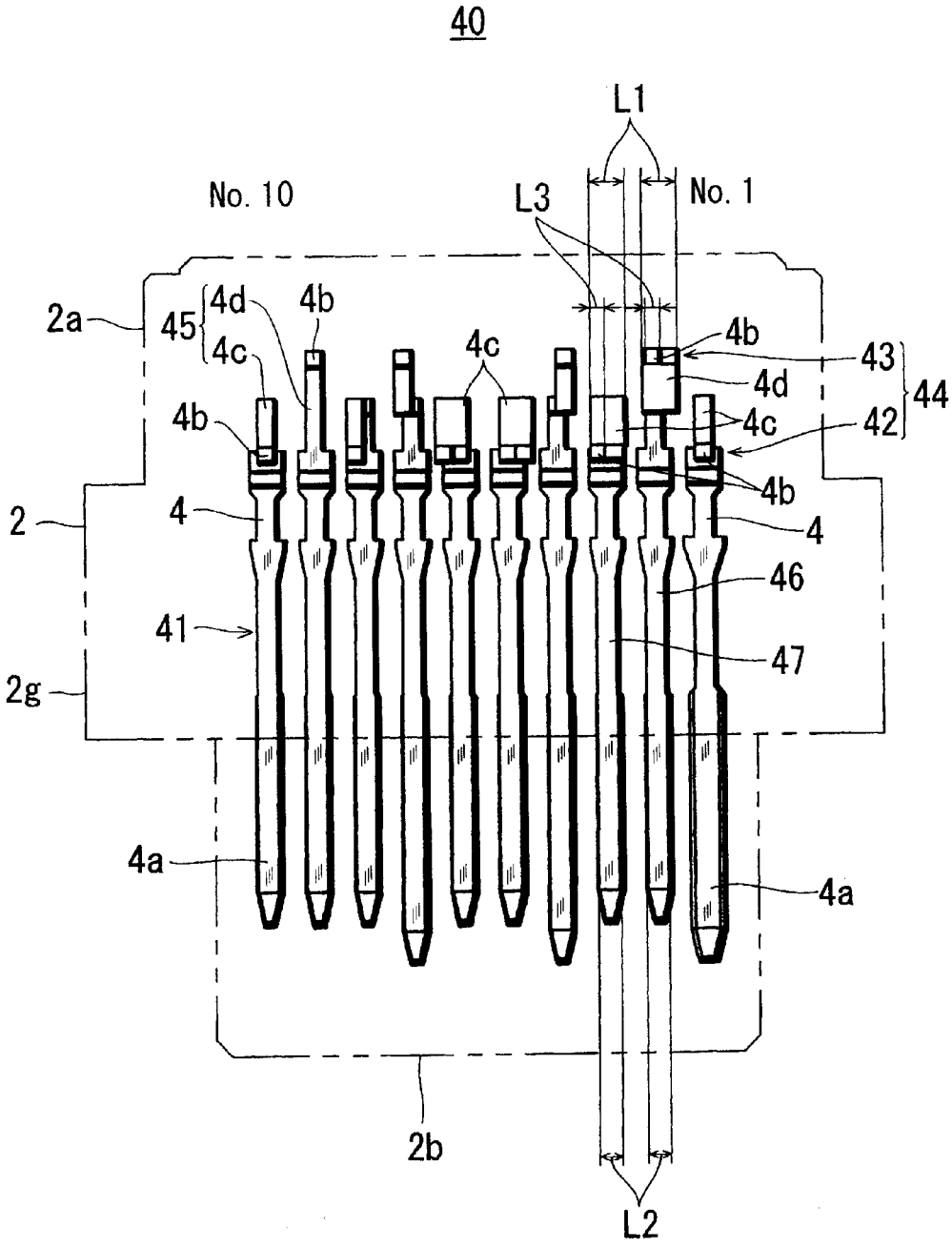
FIG. 11 is a bottom view of the lower terminal group of the multipolar connector.
Figure 12:
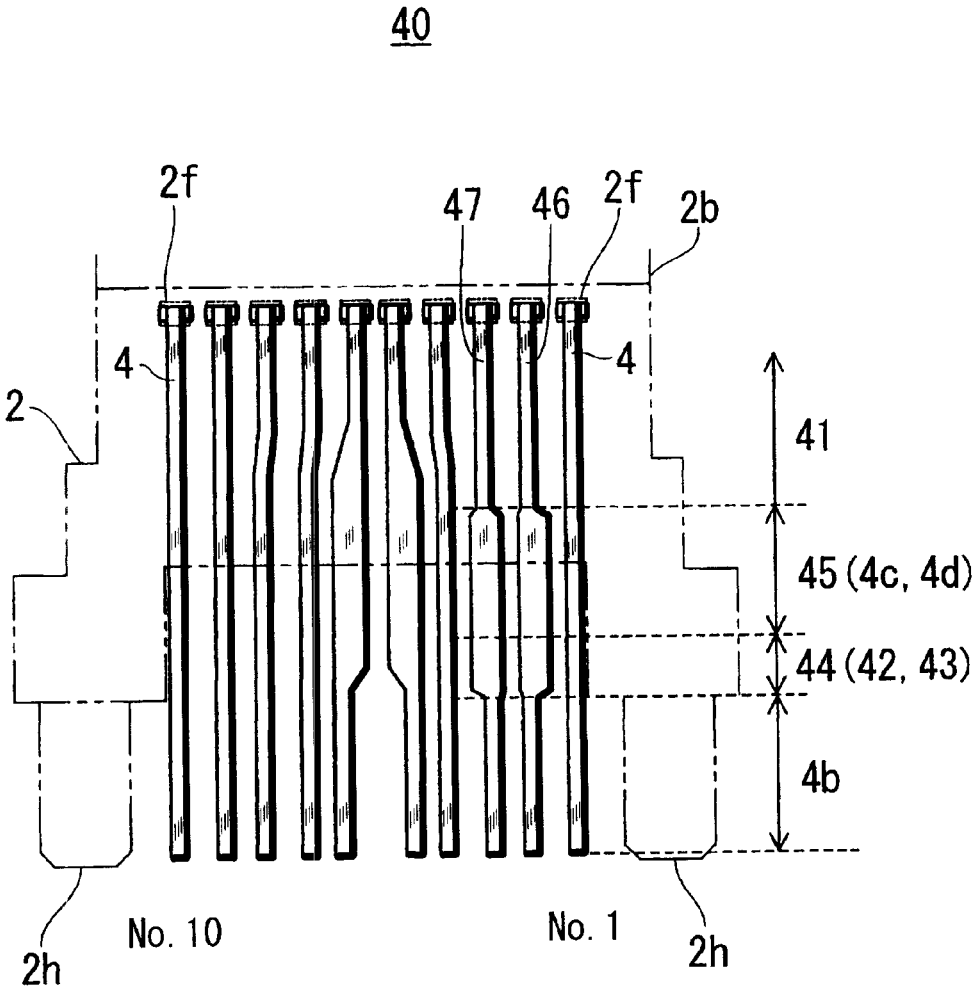
FIG. 12 is a rear view of the lower terminal group of the multipolar connector.
Figure 13:
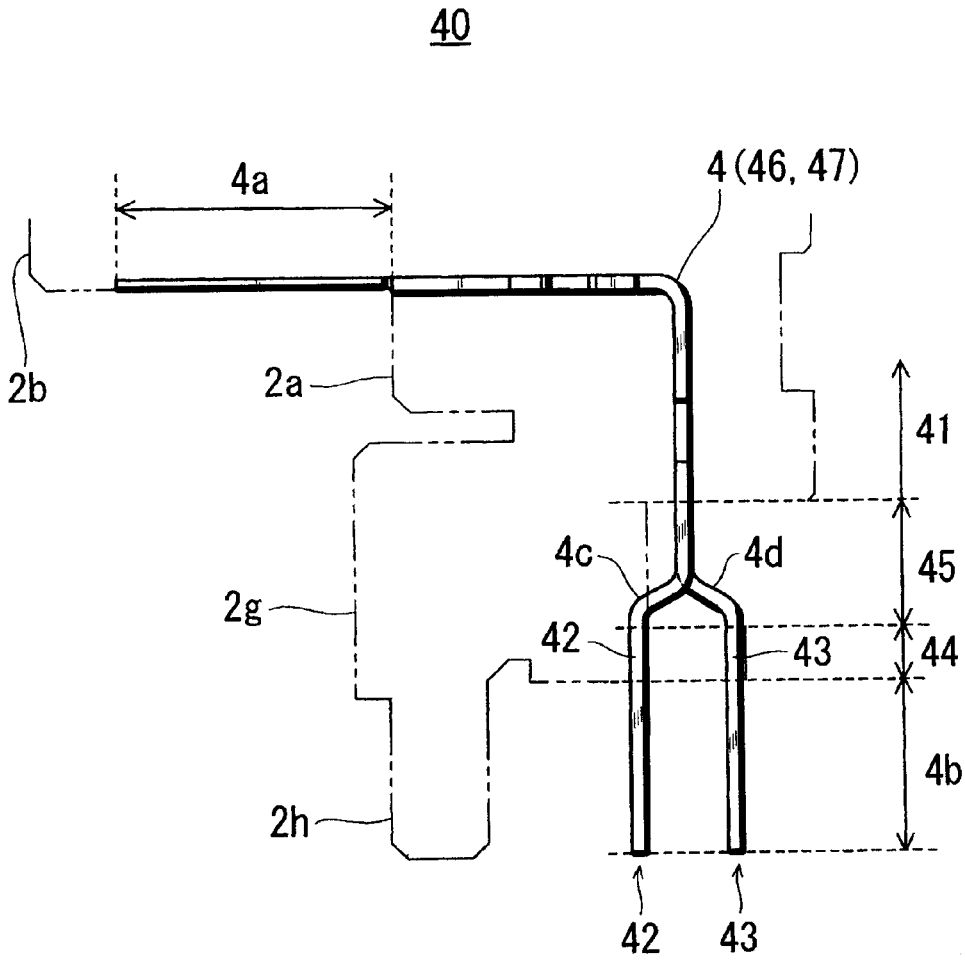
FIG. 13 is a side view of the lower terminal group of the multipolar connector.

FIGS. 10 to 13 show a specific example of the row conversion. In FIGS. 10 to 12, for the sake of convenience, the description is made while the ten lower terminals 4 are designated by respective terminal numbers. The lower terminal 4 in the right end is designated as No. 1, the subsequent lower terminals are designated respectively as No. 2, No. 3, . . . as leftward advancing, and the lower terminal 4 in the left end is designated as No. 10.

As shown in FIGS. 10 to 13, among the ten lower terminals 4, in each of six lower terminals 4 of Nos. 1, 3, 5, 6, 8, and 10, a crank-shaped forward bent portion 4*c* is formed in a middle of the L-shaped other part so that the side (lower side) on the side of the board mounting portion 4*b* with respect to the middle is downward drawn out slightly in front of the side (upper side) on the side of the contact portion 4*a*. In each of the remaining four lower terminals 4 of Nos. 2, 4, 7, and 9, a crank-shaped rearward bent portion 4*d* which is longitudinally symmetric is formed in a middle of the L-shaped other part so that the side (lower side) on the side of the board mounting portion 4*b* with respect to the middle is downward drawn out slightly in rear of the side (upper side) on the side of the contact portion 4*a*. The forward bent portions 4*c* and the rearward bent portions 4*d* constitute the inverted Y-shaped row converting portion 45. The one terminal row 41 is divided (branched) into the two front and rear rows 42, 43, i.e., the plural-row portion 44 in front of the board mounting portions 4*b*, and row-converted to a substantially zigzag arrangement by the row converting portion 45.

In this way, the multipolar connector includes the lower terminal group 40 in which, in the contact portions 4*a* with respect to the lower terminals of the counter connector, the ten lower terminals 4 are arranged in one lateral row, and, while being then passed through the row converting portion 45, the one terminal row 41 is divided into the plural-row portion 44 consisting of the two front and rear rows 42, 43 that form the connecting portion opposite to the counter connector. Therefore, the limitation due to the pitch of the through holes 103 is mitigated, so that the pitch of the ten lower terminals 4 can be further reduced, and hence further miniaturization and increase of terminals can be realized.

The lower terminal group 40 has a terminal pair in which two adjacent terminals for transmitting high-speed differential signals are paired. When the one terminal row 41 is divided into the plural-row portion 44 consisting of the two front and rear rows 42, 43 in front of the board mounting portions 4*b*, and row-converted to a substantially zigzag arrangement by the row converting portion 45, it is configured so that the terminal pair is separated to rows (the front row 42 and the rear row 43) which are different from each other. In the case where the terminal pair consists of two lower terminals 4 of Nos. 2 and 3, the gap between the two lower terminals 4 of Nos. 2 and 3 is increased by the plural-row portion 44, and the electrical coupling state of the terminal pair is impaired, thereby causing a problem in that an impedance mismatch is caused and high-speed differential signals cannot be efficiently transmitted. In order to solve the problem, the following countermeasure is taken. With respect to specific terminals 46, 47 constituting a terminal pair in which impedance matching must be achieved (in this case, the two lower terminals 4 of Nos. 2 and 3), the terminal width L1 in the plural-row portion 44 is made wider than the terminal width L2 in the contact portion 4*a* (L1>L2) as shown in FIGS. 10 to 13. Then, the impedances are previously matched to each other between the contact portions 4*a* of the two specific terminals 46, 47, the capacitance is increased by increasing the terminal widths L1 of the two specific terminals 46, 47 in the plural-row portion 44, and the increase of the impedance between the two specific terminals 46, 47 is suppressed. Namely, an impedance mismatch is reduced.

As described above, the lower terminal group 40 includes the two specific terminals 46, 47 in which the terminal width L1 in the plural-row portion 44 is wider than the terminal width L2 in the contact portion 4*a*. According to the configuration, while reducing an impedance mismatch, the one terminal row 41 can be divided into the two front and rear rows 42, 43, and row-converted to a substantially zigzag arrangement.

In the row converting portion 45, the ten lower terminals 4 containing the two specific terminals 46, 47 are bent, and the one terminal row 41 is divided into the plural-row portion 44 consisting of the two front and rear rows 42, 43, and therefore a resistance for a high frequency is easily produced, so that, in the two specific terminals 46, 47, the impedance is caused to be increased in a similar manner as the plural-row portion 44. By contrast, when the terminal width L1 is to be increased in the plural-row portion 44, the terminal width L1 is increased starting from the row converting portion 45 as shown in FIGS. 10 to 13, so that the impedance matching can be easily attained.

As described above, in the two specific terminals 46, 47, the terminal width L1 in the plural-row portion 44 is wider than the terminal width L2 in the contact portion 4*a*. When the terminal width L3 in the range to the board mounting portion 4*b* is wider than the terminal width L2 in the contact portion 4*a*, the through holes 103 of the printed circuit board 100 into which the board mounting portions 4*b* of the two specific terminals 46, 47 are respectively inserted must be through holes that are larger than the through holes 103 of the printed circuit board 100 into which the board mounting portions 4*b* of the eight lower terminals 4 other than the two specific terminals 46, 47 are respectively inserted, thereby impeding further reduction of the pitch of the ten lower terminals 4. Therefore, the terminal widths L3 of the two specific terminals 46, 47 in the board mounting portions 4*b* are made narrower than the terminal width L1 in the plural-row portion 44 (L3<L1). Preferably, the widths are made narrower than the terminal widths L2 of the contact portions 4*a* of the two specific terminals 46, 47 (L3<L2), and more preferably narrowed to the terminal widths L3 of the plural-row portion 44 (the terminal widths of the board mounting portions 4*b* of the eight lower terminals 4 other than the two specific terminals 46, 47) which are formed before the widening in the plural-row portion 44, as shown in FIGS. 10 to 13. According to the configuration, the effects achieved by the above-described row conversion can be effectively obtained.

As shown in FIGS. 10 to 13, although the row conversion is not performed between the two middle lower terminals 4 of Nos. 5 and 6, also the terminal widths of the two lower terminals 4 are widened in the plural-row portion 44 and the row converting portion 45. This is performed for adjusting the pitches of the all lower terminals 4, or namely in the board mounting portions 4*b* of the whole lower terminal group 40.

In place of the above-described row converting structure of the lower terminal group 40, also a configuration where, for example, the L-shaped one parts of the ten lower terminals 4 are alternately lengthened and shortened may allow the one terminal row 41 to be divided into the plural-row portion 44 consisting of the two front and rear rows 42, 43 and row-converted to a substantially zigzag arrangement. In this case, a space for row conversion must be ensured in rear of the rear face of the body 2, and the size of the multipolar connector 1 is increased. As shown in FIGS. 10 to 13, when the row conversion is performed preferably in the vicinity of the board mounting portions 4*b* of the ten lower terminals 4 while avoiding the upper areas of the L-shaped other parts of the ten lower terminals 4 (avoiding the positions of the lower-terminal insertion holes 2*f*), however, the one terminal row 41 can be divided into the plural-row portion 44 consisting of the two front and rear rows 42, 43 and row-converted to a substantially zigzag arrangement, in the lower-terminal housing recess 2*i* in which the rear face of the body 2 is recessed. Therefore, the size of the multipolar connector 1 is not increased.

Although the embodiment of the invention has been described with exemplifying a lateral type mini display port connector, the invention is not restricted to this, and may be implemented in various modified manners without departing the spirit of the invention. The invention can be applied to any multipolar connector irrespective of the lateral type or the vertical type, or various standards, and particularly preferably applied to a multipolar connector which is to be insert-mounted with a reduced pitch.

DESCRIPTION OF REFERENCE NUMERALS

1 multipolar connector
4 lower terminal
4*a* contact portion
4*b* board mounting portion
4*c* forward bent portion
4*d* rearward bent portion
40 lower terminal group
41 one terminal row
42, 43 two front and rear terminal rows
44 plural-row portion
45 row converting portion
46, 47 specific terminal
100 printed circuit board

What is claimed is:

1. A multipolar connector, wherein said multipolar connector includes a terminal group in which a plurality of terminals are arranged in one row in contact portions with respect to terminals of a counter connector, and, while passing through a row converting portion, said one row is divided into a plural-row portion consisting of two or more rows and functioning as a connecting portion that is opposite to the counter connector, wherein:

in said terminal group, each of said plural terminals is respectively formed into an L-shape having one end and another end, said L-shaped terminals having said contact portions on said one end, said terminals are arranged in one row up to a middle portion of the other end of the L-shaped terminals, and, while passing through the row converting portion, said one row is divided into said plural-row portion consisting of two or more rows and functioning as said connecting portion, and said terminal group includes a plurality of specific terminals which, in said plural-row portion, have a terminal width that is wider than a width of said contact portions, and in said specific terminals, the terminal width is widened starting from said row converting portion;

wherein said specific terminals are a terminal pair in which two adjacent terminals that are separated to different rows in said plural-row portion are paired, and used for transmitting a pair of differential signals.

2. The multipolar connector according to claim 1, wherein, in said row converting portion, said one row is divided into the plural-row portion consisting of two rows to be row-converted to a substantially zigzag arrangement.

3. The multipolar connector according to claim 1, wherein said multipolar connector is a multipolar connector which is to be mounted on a printed circuit board, and, the terminal width in board mounting portions located in a tip end of said plural-row portion is narrower than a terminal width at said plural-row portion.

* * * * *